US009771720B2

(12) United States Patent
Martin

(10) Patent No.: US 9,771,720 B2
(45) Date of Patent: Sep. 26, 2017

(54) RAIN GUTTER SYSTEM

(71) Applicant: Daniel Robert Martin, Marshville, NC (US)

(72) Inventor: Daniel Robert Martin, Marshville, NC (US)

(73) Assignee: Daniel Robert Martin, Marshville, NC (US)

( * ) Notice: Subject to any disclaimer, the term of this patent is extended or adjusted under 35 U.S.C. 154(b) by 0 days.

(21) Appl. No.: 14/841,539

(22) Filed: Aug. 31, 2015

(65) Prior Publication Data

US 2016/0060870 A1 Mar. 3, 2016

Related U.S. Application Data

(60) Provisional application No. 62/044,316, filed on Aug. 31, 2014.

(51) Int. Cl.

| | |
|---|---|
| ***E04D 13/064*** | (2006.01) |
| ***E04D 13/076*** | (2006.01) |
| ***E04D 13/072*** | (2006.01) |

(52) U.S. Cl.

CPC ..... *E04D 13/064* (2013.01); *E04D 13/0643* (2013.01); *E04D 13/076* (2013.01); *E04D 13/0725* (2013.01)

(58) Field of Classification Search

CPC ..... E04D 13/0767; E04D 13/064; E04D 13/0643; E04D 13/0725

USPC ..... 52/11, 12

See application file for complete search history.

(56) References Cited

U.S. PATENT DOCUMENTS

| | | | | |
|---|---|---|---|---|
| 836,012 | A | 11/1906 | Cassen | |
| 2,045,632 | A * | 6/1936 | Colby | B01J 35/02 422/211 |
| 2,271,081 | A | 1/1942 | Layton | |
| 2,636,458 | A | 4/1953 | Harris | |
| 2,672,832 | A | 3/1954 | Goetz | |
| 2,988,226 | A * | 6/1961 | Campbell | E04D 13/076 210/474 |
| 3,053,393 | A | 9/1962 | McLean | |
| 3,296,749 | A | 1/1967 | Cotter | |

(Continued)

FOREIGN PATENT DOCUMENTS

| | | | |
|---|---|---|---|
| CA | 2493006 | A1 | 7/2006 |
| DE | 3536266 | A1 | 4/1986 |

(Continued)

*Primary Examiner* — Brent W Herring
(74) *Attorney, Agent, or Firm* — Typha IP LLC

(57) ABSTRACT

A rain gutter system, including a gutter, and a debris cover, and a method of manufacturing the gutter and the debris cover, wherein the gutter includes a front wall and a back wall interconnected through a bottom and spaced-apart to cooperatively define a water-collecting channel therebetween, the front wall including a lip extending in the direction toward the back wall and a drip edge extending in a direction away from the back wall, the back wall extending upward vertically beyond the height of the front wall. In further embodiments, the rain gutter system includes at least one hanger, and the at least one hanger is positioned in the channel of the gutter, spaced-apart from the bottom. The debris cover allows water to penetrate the debris cover, is attached on top of the gutter at a desirable pitch, and includes a mircomesh.

16 Claims, 13 Drawing Sheets

(56) References Cited

U.S. PATENT DOCUMENTS 3,344,561 A 10/1967 Anderson
3,426,987 A 2/1969 Leslie
4,497,146 A 2/1985 Demartini
4,713,915 A 12/1987 Sweers
4,796,390 A 1/1989 Demartini
4,901,954 A 2/1990 Fairgrieve et al.
4,910,926 A 3/1990 Paulsson
5,010,696 A * 4/1991 Knittel ..... E04D 13/076 210/474
5,040,750 A 8/1991 Brant
5,092,086 A 3/1992 Rognsvoog, Sr.
5,388,377 A 2/1995 Faulkner
5,417,015 A 5/1995 Coyne
5,575,118 A 11/1996 Vahldieck
5,617,678 A 4/1997 Morandin et al.
5,619,825 A 4/1997 Leroney et al.
5,687,510 A 11/1997 Basista
5,737,879 A 4/1998 Sweet
6,016,631 A 1/2000 Lowrie
6,209,826 B1 4/2001 Pratt
6,254,039 B1 7/2001 Zimmerman
6,367,743 B1 4/2002 Iannelli
6,543,729 B1 4/2003 Ylonen
6,598,352 B2 * 7/2003 Higginbotham ..... E04D 13/076 210/474
6,631,587 B2 10/2003 Lynch
6,658,796 B1 12/2003 Higgins
6,681,527 B2 1/2004 Baker
6,854,692 B1 2/2005 Winkel
6,968,651 B2 11/2005 Bergeron
7,117,642 B2 10/2006 Brown
7,191,564 B2 * 3/2007 Higginbotham ..... E04D 13/076 210/474
7,310,912 B2 * 12/2007 Lenney ..... E04D 13/076 210/162
7,494,095 B2 2/2009 Walker et al.
7,523,894 B1 4/2009 Eddy
7,624,541 B2 * 12/2009 Gentry ..... E04D 13/076 248/48.1
7,650,720 B2 * 1/2010 Ealer, Sr. ..... E04D 13/076 210/498
7,730,672 B2 6/2010 Knudson et al.
7,752,812 B2 7/2010 Knudson et al.
7,913,458 B2 * 3/2011 Higginbotham ..... E04D 13/076 52/11
7,975,435 B2 * 7/2011 Lenney ..... E04D 13/076 52/11
8,001,729 B2 8/2011 Joly et al.
8,079,183 B2 * 12/2011 Lenney ..... E04D 13/0762 219/213
8,397,436 B2 * 3/2013 Higginbotham ..... E04D 13/076 52/11
8,418,410 B2 * 4/2013 Martin ..... E04D 13/0725 248/48.1
8,438,787 B2 * 5/2013 Lenney ..... E04D 13/0762 219/213
8,479,454 B2 * 7/2013 Lenney ..... E04D 13/076 248/48.1
8,495,837 B2 * 7/2013 McCoy ..... E04D 13/076 52/12
8,528,262 B2 * 9/2013 Horton ..... E04D 13/076 248/48.1
8,635,811 B2 * 1/2014 Horton ..... E04D 13/076 52/11
8,677,695 B2 * 3/2014 McCoy ..... E04D 13/076 52/12
8,756,868 B2 * 6/2014 McCoy ..... E04D 13/076 52/12
9,010,030 B2 * 4/2015 Davis ..... E04D 13/076 52/11
9,127,463 B1 * 9/2015 Feldhaus ..... E04D 13/0725
9,487,955 B2 * 11/2016 Breyer ..... E04D 13/076
2002/0124485 A1 * 9/2002 Pulte ..... E04D 13/064 52/96
2003/0046876 A1 * 3/2003 Higginbotham ..... E04D 13/076 52/11
2004/0000098 A1 1/2004 Knudson
2005/0144851 A1 7/2005 Gramling
2005/0204642 A1 9/2005 Valentini
2006/0123710 A1 * 6/2006 Lenney ..... E04D 13/076 52/12
2006/0179723 A1 * 8/2006 Robins ..... E04D 13/076 52/11
2007/0234647 A1 * 10/2007 Higginbotham ..... E04D 13/076 52/12
2007/0277446 A1 12/2007 Dowling et al.
2008/0163561 A1 * 7/2008 Lenney ..... E04D 13/076 52/12
2009/0235592 A1 9/2009 Knudson et al.
2010/0287846 A1 * 11/2010 Lenney ..... E04D 13/0762 52/12
2011/0056145 A1 3/2011 Lenney et al.
2011/0067318 A1 * 3/2011 Lenney ..... E04D 13/076 52/12
2011/0126477 A1 6/2011 Hurn
2012/0042579 A1 * 2/2012 McCoy ..... E04D 13/076 52/12
2012/0110922 A1 * 5/2012 Hawes ..... E04D 13/076 52/12
2012/0159868 A1 * 6/2012 Lenney ..... E04D 13/0762 52/12
2012/0222366 A1 * 9/2012 Steinberg ..... E04D 13/076 52/12
2013/0152484 A1 * 6/2013 Horton ..... E04D 13/076 52/12
2013/0276378 A1 * 10/2013 McCoy ..... E04D 13/076 52/12
2013/0276379 A1 * 10/2013 McCoy ..... E04D 13/076 52/12
2014/0215929 A1 * 8/2014 Lenney ..... E04D 13/076 52/12
2014/0250827 A1 * 9/2014 Gillman ..... E04C 2/38 52/745.21
2014/0290511 A1 * 10/2014 Stecker ..... B41M 1/12 101/129
2015/0040488 A1 * 2/2015 Lenney ..... E04D 13/076 52/12
2015/0354226 A1 * 12/2015 Lenney ..... E04D 13/076 52/12
2016/0102459 A1 * 4/2016 Breyer ..... E04D 13/076 52/12

FOREIGN PATENT DOCUMENTS

GB 2123049 A 1/1984
JP 06057894 A 3/1994
WO 2004003310 A1 1/2004

* cited by examiner

RAIN GUTTER SYSTEM

PRIORITY CLAIM AND CROSS-REFERENCE TO RELATED APPLICATION(S)

The present application claims priority to U.S. Provisional Patent Application Ser. No. 62/044,316, filed Aug. 31, 2014, entitled "RAIN GUTTER SYSTEM," which is incorporated herein by reference in its entirety.

BACKGROUND INFORMATION

Conventional gutter systems and gutter covers have been developed in an attempt to collect water while preventing debris from collecting within the gutter. Such systems typically require installation methods that disadvantageously damage the sealing integrity of the roof, fail to address "backflow" affecting the underlying fascia and water collection, and include covers oriented at undesirable slopes and in undesirable designs, causing debris to collect thereon and/or inadequate water collection. Additionally, the prior art methods of manufacturing gutter systems including gutters, and debris covers with complex cross-sections profile, are complicated and expensive processes, such as methods that uses an extrusion processes, and include heavy, complex, and high maintenance machinery. Accordingly, there is a need for rain gutter system and the method of manufacturing a gutter and a debris cover that overcomes these shortcomings.

BRIEF SUMMARY

The present application relates generally to the field of rain gutter systems for building structures, and more particularly, to a rain gutter system including a gutter, and a debris cover (debris panel), and method of manufacturing a gutter and a debris cover, the gutter having a continuous cross-sectional profile defining an integrated drip edge for directing water away from a front wall of the gutter and a high-back for protecting the underlying fascia of the structure the against backflow of liquid, such as rainwater. In further embodiments, the system further includes at least one internal hanger for securing the gutter to an underlying fascia of the structure/rafter tails and supporting an overlying debris cover at a predetermined pitch in the direction toward the drip edge. The debris cover, including a micromesh panel and at least one elongated channel, and having a continuous cross-sectional profile. The debris cover further having a surface with openings defined therethrough, at least one elongated channel and a mesh on top of the surface configured to allow liquids to penetrate the debris cover and into the at least one elongated channel. The micromesh further including a mesh screen. The at least one elongated channel having at least one opening, being configured to allow liquid to pool within the at least one elongated channel and being configured to allow liquids to flow out of the at least one elongated channel and debris cover via the at least one opening.

In one aspect, a rain gutter system, including a gutter and a debris cover, and method of manufacturing a gutter and a debris cover for collecting water run-off from an overlying roof, are provided herein.

In yet further embodiments, the gutter and the debris cover are manufactured using roll forming process for providing a simple and cost effective form of manufacturing the system, and eliminating the need of having a gutter and/or mesh machine in every truck used by a gutter company when installing the gutter.

In further embodiments, the micromesh panel is formed by rotary punching the panel, feeding the screen into the panel in an open configuration, and rolling such that the screen is pulled into the shape of the panel and locked in such configuration.

In embodiments, the rain gutter system is configured for use with a variety of conventional debris covers generally including at least one elongated channel member covered with a fine mesh, or with the debris cover provided herein. In further embodiments, the micromesh panel is configured for retroactive fitting to conventional gutter systems.

In yet another embodiment, the gutter and the debris cover include a continuous cross-sectional profile.

In embodiments, the gutter includes an integrated drip edge for directing water away from the front wall of the gutter, and a raised back wall for protecting the underlying fascia of the building structure from water backflow. In embodiments, the raised back wall of the gutter is secured to the gutter, thereby not the gutter system is not fixed to the roof of the structure. In embodiments, the gutter system is further secured to the building structure by a hem that extends behind the drip edge fascia of the structure, and such a configuration protects the fascia from water damage.

In further embodiments, the rain gutter system includes at least one internal hanger for securing the gutter to rafter tails or the underlying fascia of the structure, wherein the at least one hanger is installed using conventional fasteners advanced though the hanger, back wall and fascia of the structure and into the rafter tails.

In yet other embodiments, the debris cover is provided for draining the water, while preventing debris from penetrating the debris cover and, consequently, from reaching the channel of the gutter. In yet further embodiments, the debris cover includes one or more channels that define openings therethrough for passing water to a channel of the gutter. In embodiments, the water passed to the channel of the gutter is passed to a downspout. In yet further embodiments, the water passed to the downspout is collected by a water harvesting system that includes a reservoir for collecting and storing the water passed openings of the debris cover.

In embodiments, the back wall extends vertically beyond the height of the front wall and terminates in a fold in the direction of the channel such that a flange of the back wall and a supporting surface of an installed internal hanger define a space therebetween for receiving and maintaining an upper edge of an installed debris cover.

In embodiments, the debris cover is attached to the gutter system without using nails, screws, or any other fastening piece, while being safely secured in the system. In yet other embodiments, the debris cover is attached to the gutter.

In yet another embodiment, the internal hangers cooperatively support and determine the slope of the installed debris cover. In further embodiments, the internal hanger provide are pitched downward at a predetermined angle, to permit a sloping of the debris cover that is supported by the internal hangars.

In yet further embodiments, the debris cover is attached solely to the gutter system, including the gutter and the hanger, as opposed to the roof or fascia of the structure, or any other part of the roof or fascia, so as to avoid any gap that would allow the debris to reach the channel of the gutter.

In yet another embodiment, the debris cover includes a fine brim in the lower edge of the cover that allows the debris to be driven out of the debris cover, and ultimately the gutter system, while allowing the system to drain the water to the internal wall of the gutter system and maintaining both the internal part of the gutter and external top part of the debris cover of the gutter system free of debris.

In yet another embodiment, the internal hangers span and maintain the distance between the front and back walls of the gutter.

In yet another embodiment, the internal hangers resist downward rotational forces on the front wall of the gutter.

In yet another embodiment, the gutter is formed by bending a single piece of planar material into a predetermined shape having a profile defining a front lip in the direction of the back wall under which a forward edge of the internal hangers is captured, a drip edge extending forward of the front wall in the direction away from the back wall, a high back wall, and a fold at the free end of the back wall in the direction of the channel. The debris cover includes a surface with at least one elongated channel and openings defined therethrough, and mesh on top of the surface.

In yet another embodiment, the drip edge includes the edge of the gutter and the edge of the debris cover.

In yet another embodiment, the drip edge is a separate body that is attached to the gutter.

In another embodiment, the method of manufacturing the gutter and the debris cover uses a roll forming technique, wherein a metal sheet is unrolled into a conventional or modified roll forming machine, that includes rolling over a number of roll stands. In embodiments, the rolling process includes eighteen roll stands for the debris cover and thirteen roll stands for the gutter, and cut in the desired length. In embodiments, the debris cover is rotary punched to created openings defined by the channels of the debris cover.

In another embodiment, the method of manufacturing the gutter system includes manufacturing a mesh that may be at least 10 feet of screen long for avoiding connectors between cover pieces used in conventional covers.

To achieve the foregoing and other aspects and advantages, in one embodiment the present invention provides a rain gutter system including a gutter, at least one hanger, and a debris cover, the gutter including a front wall and a back wall interconnected through a bottom and spaced-apart to cooperatively define a water-collecting channel therebetween, the front wall including a lip extending from the front wall in a direction toward the back wall and a drip edge extending beyond the front wall in a direction away from the back wall, the back wall extending upward vertically beyond the height of the front wall and terminating in a fold in a direction toward the bottom, wherein the at least one hanger secured within the channel between the front wall and the back wall and spaced apart from the bottom, the hanger including a forward flange extending upwardly from a base of the hanger for being captured beneath the lip and a rear flange extending upwardly from the base and defining a support surface sloped in a direction toward the drip edge, and a debris cover configured to allow water to penetrate the debris secured in the upper edge by the support surface of the hanger and in the lower edge by the front lip of the gutter.

The debris cover includes at least one elongated channel and openings defined therethrough, and mesh on top of the surface to allow liquids to flow into the debris cover. In further embodiments, at least one elongated channel of the debris cover includes one or more openings shaped as slots to permit the flow of liquids out of the debris cover and into the gutter. In another embodiment, the one or more slots are formed in the at least one elongated channel at a position such that when the debris cover is pitched on the gutter at an angle of about 23 degrees with respect to horizontal, the slots are slot forward at such pitch, such that liquid leaves the debris cover in a forward direction of the gutter, which is towards the drip edge. In yet another embodiment, the openings are formed so as to be in the bottom of the elongated channels.

According to another embodiment, the drip edge and the rear flange are coplanar.

In yet another embodiment, the forward flange of the hanger includes a support surface in a direction towards a fascia of the structure the gutter system is attached to.

In yet another embodiment, the rear flange includes at least one support surface in a direction towards the drip edge of the gutter system.

According to another embodiment, the support surface of the forward flange and the support surface of the rear flange extend in a direction facing one another.

In yet another embodiment, the rain gutter system causes the gutter system to reduce the movement of the gutter system caused by the flow of the water that hits the overlying debris cover.

In yet another aspect, the debris cover includes a surface with at least one channel and openings defined therethrough, and at least one elongated channel in a certain depth that allows the water to efficiently penetrate the mesh and efficiently make its course into the channels of the gutters.

In yet another embodiment, the debris cover includes horizontal elongated openings along the channels of the panel.

According to another embodiment, the rain gutter system includes a debris cover supported on the drip edge of the gutter, or on the front lip, and the rear flange and sloped in a direction toward the drip edge. In further embodiments, the debris cover is supported and pitched at an angle in the range of 23-27 degrees with respect to horizontal. In other embodiments, the pitch is 25 degrees. Alternative angles are envisioned so long as they are adequate for allowing time to collect water in the gutter system, while allowing debris to wash over and blow of the gutter system. The described degrees of pitch and placement of the openings within the channels in a slot forward design provide optimal performance for the gutter system.

According to another embodiment, the back wall of the gutter is linear and perpendicular to the bottom and the front wall is non-linear.

According to another embodiment, the support surface of the rear flange is spaced-apart from a free edge of the fold of the back wall.

According to another embodiment, the rain gutter system includes an end cap.

In accordance with another embodiment, the rain gutter system includes a gutter having a continuous cross-sectional profile formed to define a front wall and a back wall interconnected through a bottom and spaced-apart to cooperatively define a water-collecting channel therebetween, the front wall including a lip extending from the front wall in a direction toward the back wall and a drip edge extending beyond the front wall in a direction away from the back wall, the back wall extending upward vertically beyond the height of the front wall, a hanger secured within the channel between the front wall and the back wall and spaced apart from the bottom, the hanger including a forward flange extending upwardly from a base of the hanger for being captured beneath the lip and a rear flange extending upwardly from the base and defining a support surface sloped in a direction toward the drip edge, and a debris cover having a continuous cross-section profile configured to allow water to penetrate the debris secured in the upper edge by the support surface of the hanger and in the lower edge by the front lip of the gutter. The debris cover includes a surface with at least on elongated channel and openings, and mesh on top of the surface.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

Various exemplary embodiments are illustrated by way of example, and not by way of limitation, in the figures of the accompanying drawings in which like reference numerals refer to similar elements and in which: These and other features, aspects and advantages of the present invention are better understood when the following detailed description of the invention is read with reference to the accompanying drawings, in which.

DETAILED DESCRIPTION OF THE INVENTION

Figure 1:
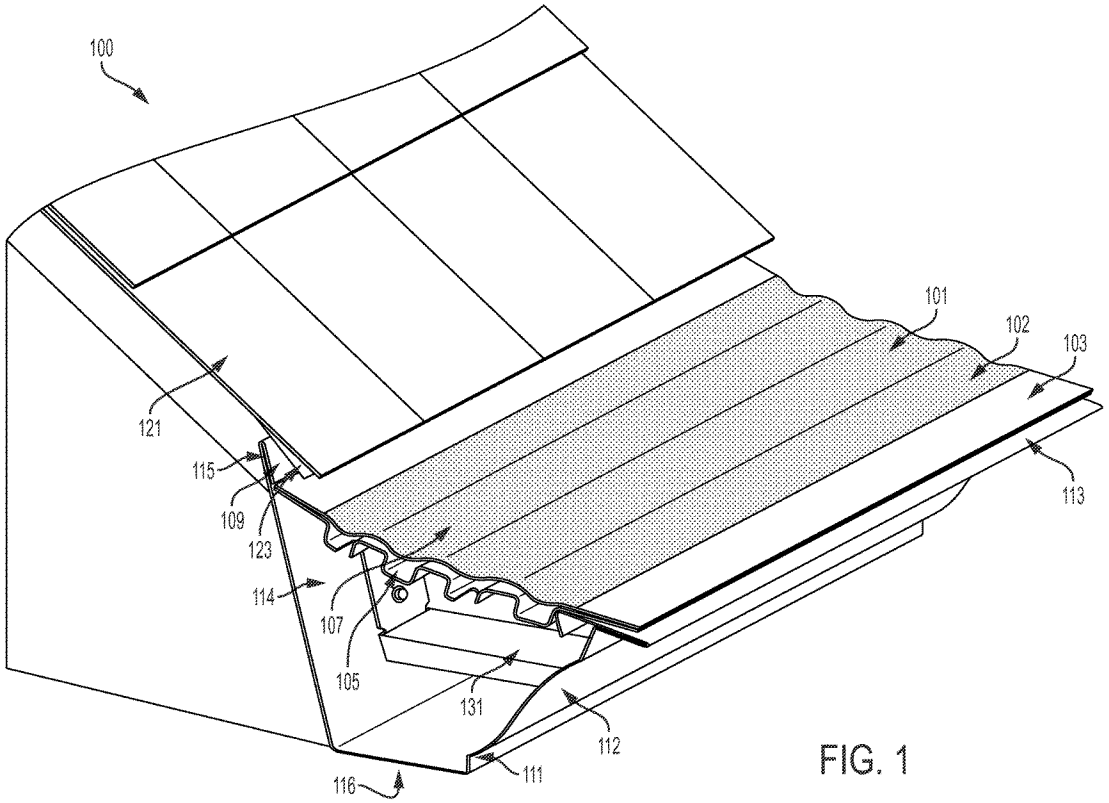
FIGS. 1-3 are various illustrations of a rain gutter system shown installed and with an end cap removed, according to exemplary embodiments.

A preferred rain gutter system, including a gutter, hanger and debris cover, and a method of manufacturing the gutter and the debris cover (panel) are described. In the following description, for the purposes of explanation, numerous specific details are set forth in order to provide a thorough understanding of the preferred embodiments of the invention. It is apparent, however, that the preferred embodiments may be practiced without these specific details or with an equivalent arrangement. In other instances, well-known structures and devices are shown in order to avoid unnecessarily obscuring the preferred embodiments of the invention.

It is intended that the gutter system provided herein may be installed as original equipment or as a retrofit application, either as a complete system or utilizing parts of the system disclosed herein. For example, in embodiments, the debris panel may be retrofitted to conventional gutter systems. In further embodiments, the debris panel may be retrofitted to conventional gutter systems using the tracking channel. The rain gutter system may additionally be used in conjunction with a rain collection system, such as a water harvesting system. In embodiments, the debris cover provided herein is attached to the gutter system without using any tool or fastening piece, such as screws and nails. The debris cover, also referred to as a panel, may be attached between the support of the hanger and the front lip of the gutter, which are spaced apart to receive the debris cover. In further embodiments, the panel is a micromesh panel. Although any materials may be used in the construction of the system components, preferable materials include those that are lightweight, malleable, corrosion-resistant and paintable, for example aluminum, copper, etc.

The gutter portion of the system, the gutter extrusion, is preferably bent/formed from a single planar length of material such that the gutter has a continuous cross-sectional profile, i.e. continuous from the free edge of the lip of the front wall to the free edge of the fold of the back wall. The continuous cross-sectional profile and along with the addition of an end cap to each end of the length of gutter makes the gutter watertight. The gutter may have any ornamental design, folds and beads. The gutter is preferably bent by machine, such as on-site, to produce the desired profile. The debris cover portion of the system may also be bent and/or formed, for example, in 10 feet long pieces of material, using a modified or conventional roll forming machine. The debris cover may also be bent and/or formed in a single length of material such that the debris cover has a continuous cross-sectional profile, i.e. continuous from the upper edge, which is supported by the rear support surface of the hanger, to the lower edge, which is supported by the gutter lip and/or by the drip edge of the gutter. In embodiments, the gutter and debris cover are roll formed. In further embodiments, the roll forming process may include multiple roll stands. In yet further embodiments, the rolling process may include eighteen roll stands.

The gutter and debris cover may be manufactured through a roll forming process, which may include bending/forming, for example, eighteen inches of planar material by a roll forming process. The roll forming method may be a modified or conventional roll forming machine that can be carried inside a small truck, or inside a conventional truck widely used by gutter companies when installing gutter systems or parts. In further embodiments, the debris cover is rotary punched to form openings in the debris cover.

In embodiments, the roll forming process of manufacturing the gutter may include a continuous bending operation of planar material through several sets of roll mounted in 13 consecutive stands, while the roll forming process of manufacturing the debris cover may include a continuous bending operation of planar material through several sets of roll mounted in 18 consecutive stands. In further embodiments, the debris cover is rotary punched to form opening in the first stand.

As shown in the drawings, the gutter 111 portion of the system 100 is designed with an overhang or backflow preventing bend, in the form of a hem 115, to prevent water from traveling upward or horizontally toward the building. Thus, each component is designed to move water away from or laterally with respect to the building/structure to which the system is attached. The drip edge 113 of the gutter 111 is designed to prevent the external wall of the gutter from becoming dirty by having dirt or mud running from the roof shingles of the front edge of the drip edge, thereby preventing the any staining of the front of the gutter, as conventional gutter systems typically develop over time.

Figure 2:
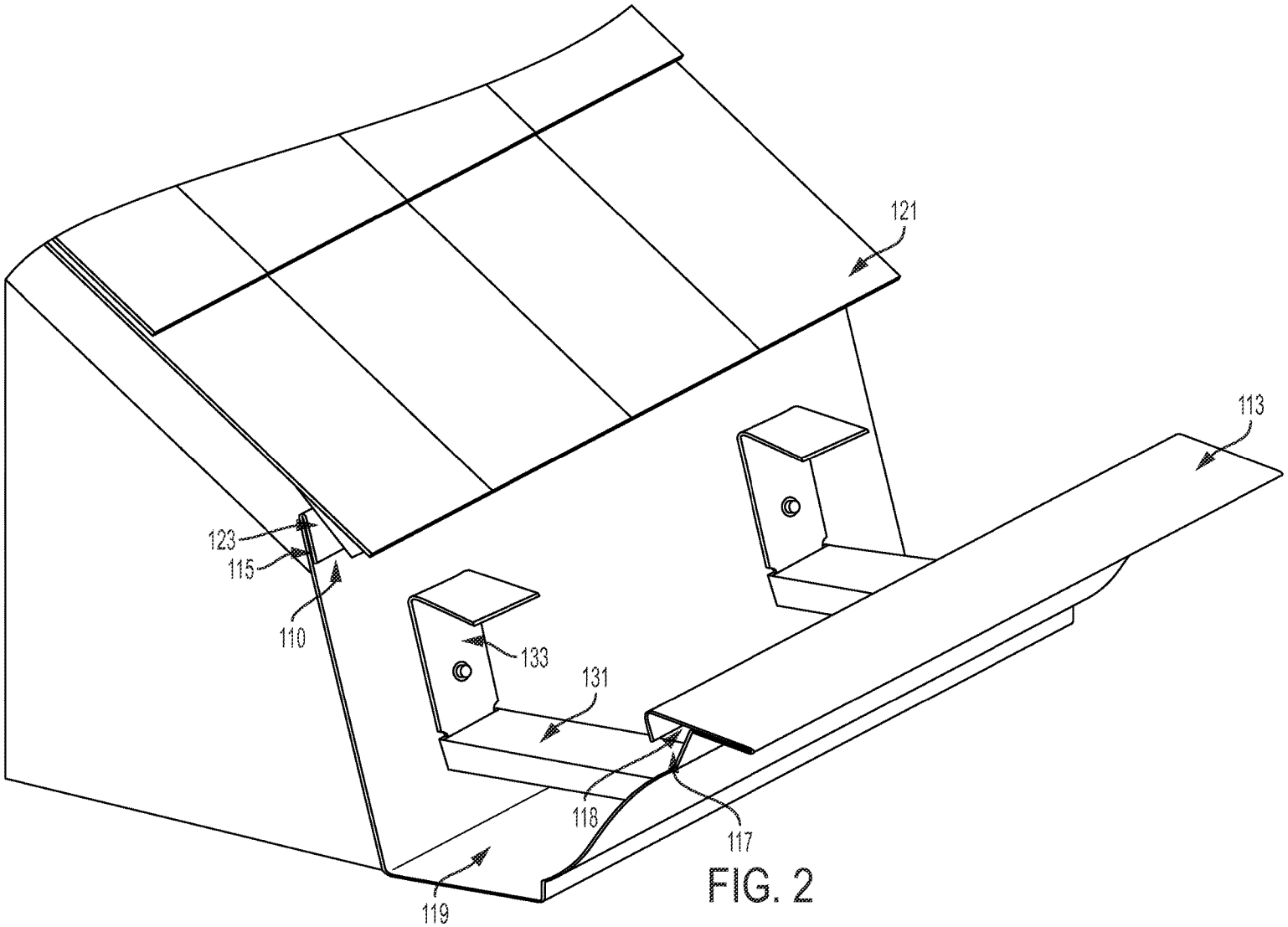
Figure 3:
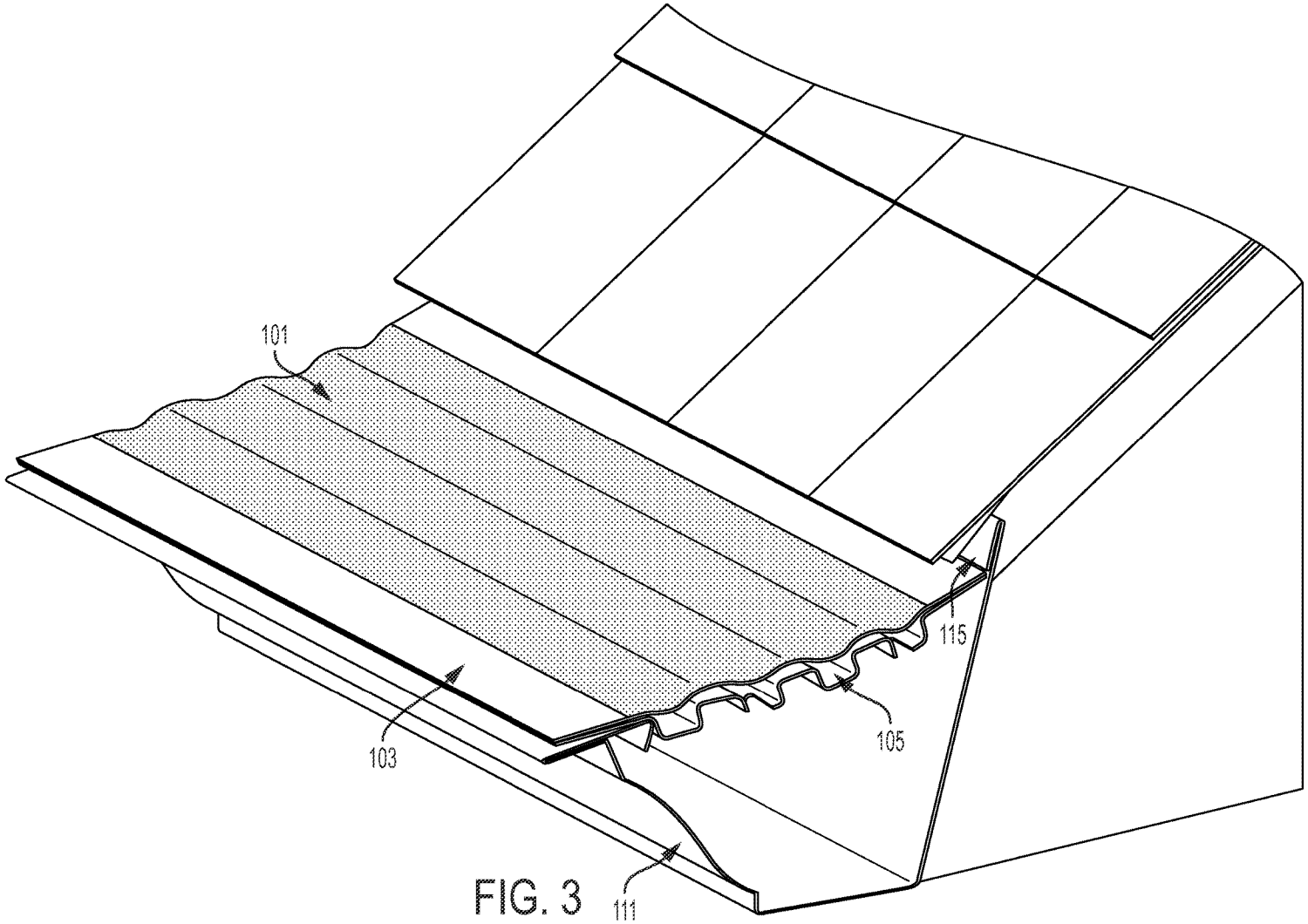

In embodiments, the rain gutter system 100 according to an embodiment of the present invention is illustrated generally at reference numeral 100. Rain gutter system 100 generally includes a gutter 111 having a cross-sectional profile as shown in FIG. 1, at least one hanger 131 installed within the gutter 111, and conventional fasteners for securing the gutter to a supporting structure, such as an underlying fascia of the structure. In embodiments, the gutter 111 can be further fastened to the fascia of the structure by positioning a hem 115 of the high back wall 114 behind a fascia drip edge 123, as illustrated in FIGS. 1-3. In embodiments, the hem 115 is a ¾ inch hem. Having the hem 115 of the high back wall 114 of the gutter allows provides protection for the fascia of the structure by preventing water that moves down the fascia drip edge 123 from traveling behind the gutter and onto the fascia of the structure. Thereby, the fascia of the structure is less likely to be damaged by water passing over the fascia drip edge 123, thus maintain the integrity of the structure as well as the stability of the gutter system 100 that is attached to the fascia of the structure. In a specific embodiment, the gutter 111 is ultimately anchored to underlying rafter tails beneath the fascia of the structure which is not shown. As shown, roof 121 overhangs gutter 111 such that water run-off from roof 121 is collected within gutter 111 and does not run down the fascia of the structure, which is not shown, and to which the gutter 111 is anchored to. In yet further embodiments, the debris panel 101, having a mesh surface, may be secured under a free end 110 of the hem 115. Although not shown, gutter 111 is coupled with at least one downspout for draining water from gutter 111 as known to those skilled in the art. In embodiments, the downspout may be coupled to a water collection system, such as a water harvesting system. In embodiments, the water harvesting system obtains and stores water from the gutter for various uses, such as irrigation, water treatment, etc. Alternatively, gutter 111 may be coupled solely to a rain collection system, rather than a downspout, as known to those skilled in the art.

Figure 4:
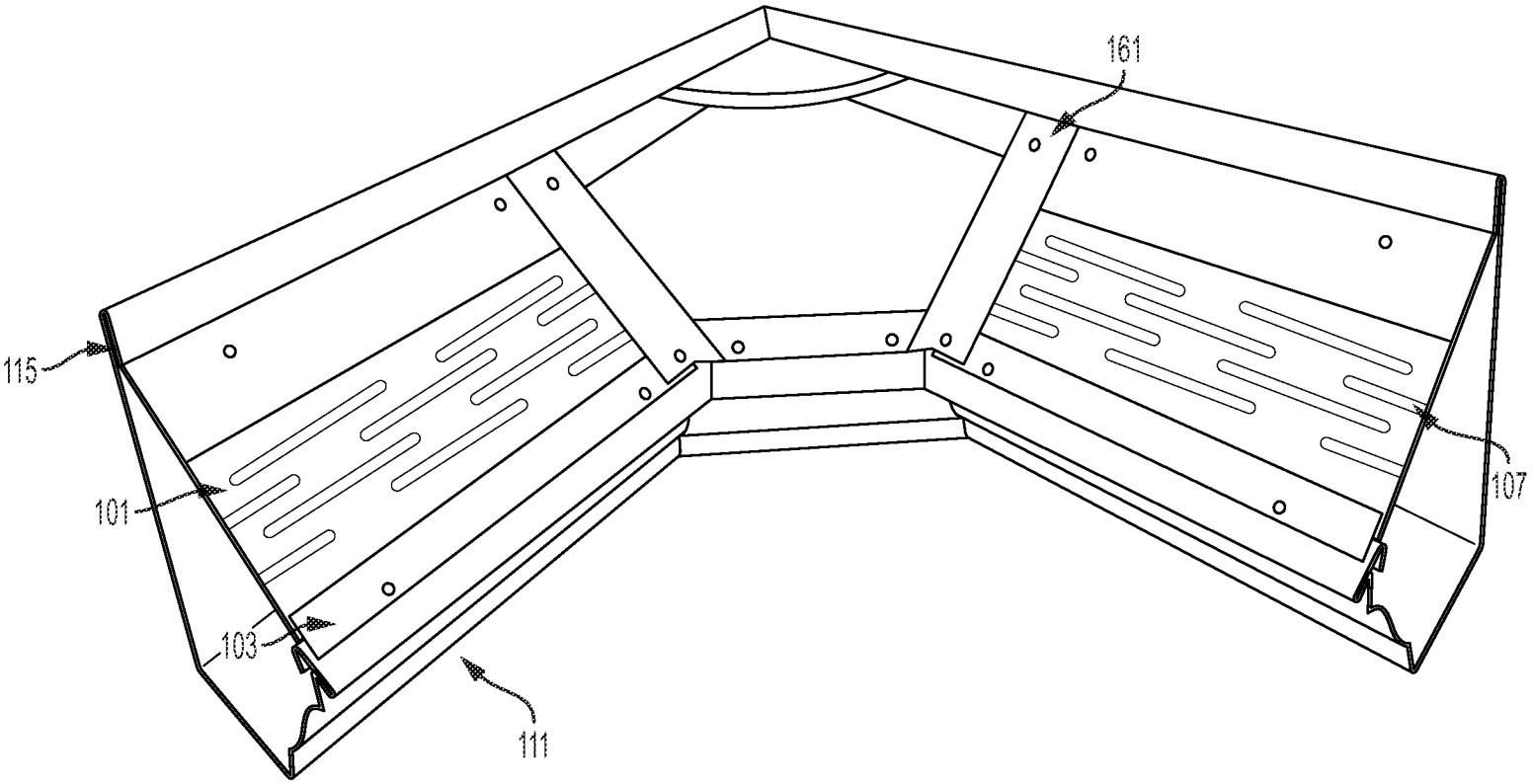
FIG. 4 is an illustration of an inside miter including an inside corner gusset of a rain gutter system, according to exemplary embodiments.
Figure 5:
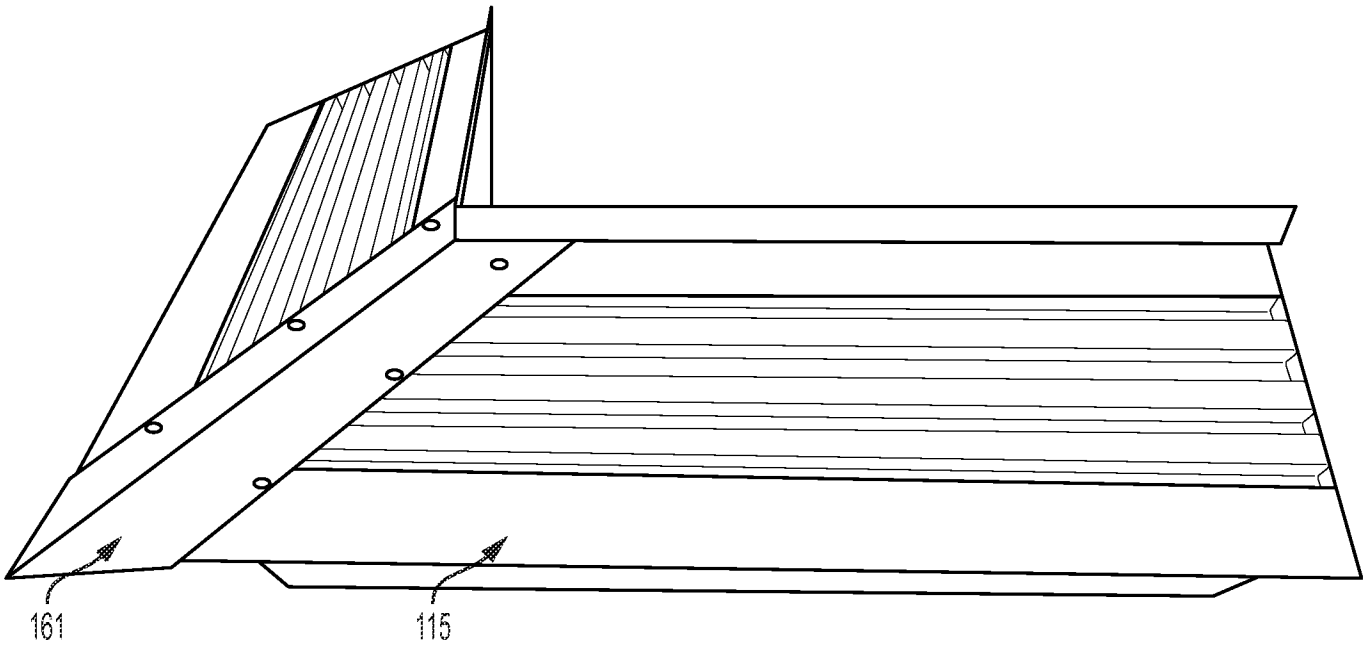
FIG. 5 is an illustration of an outside miter and corner cap of a rain gutter system, according to exemplary embodiments.
Figure 6:
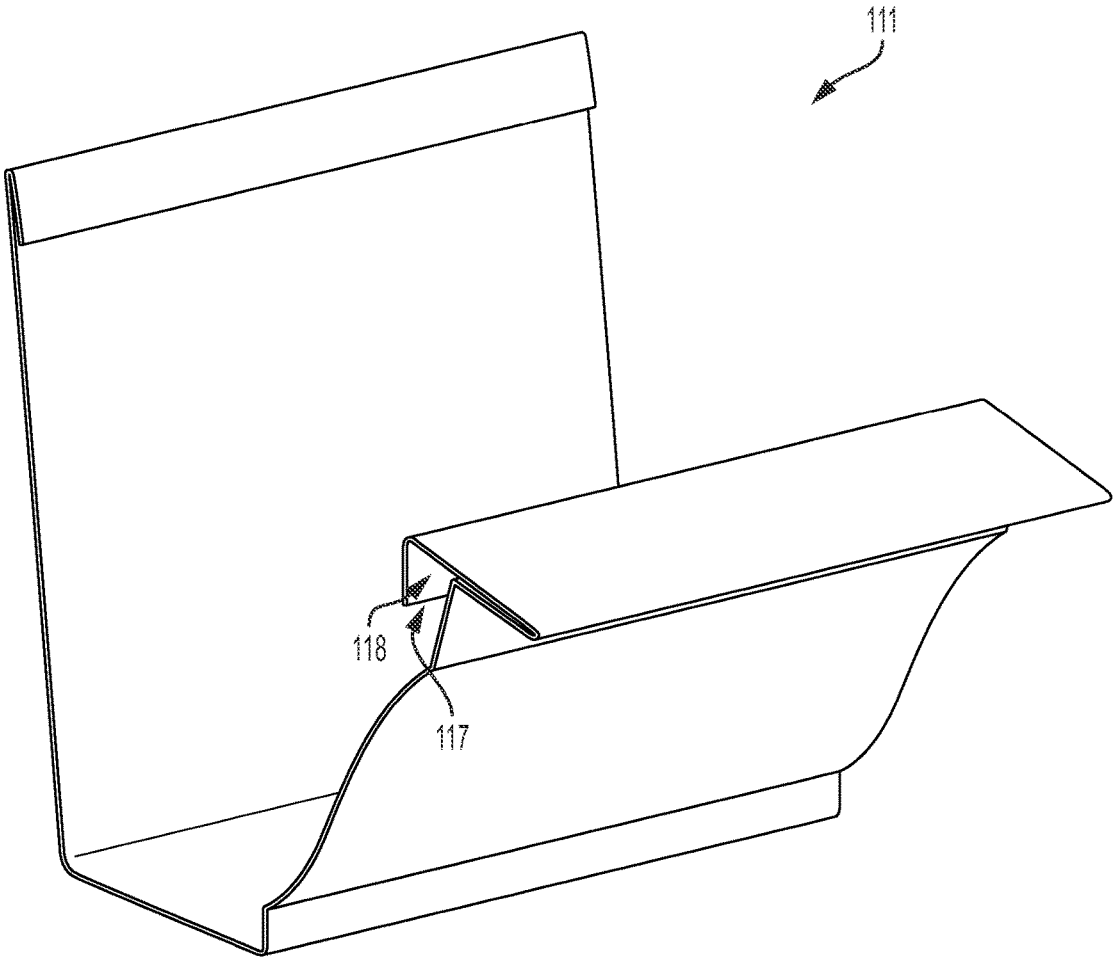
FIGS. 6 and 7 are various illustrations of rain gutter extrusions according to exemplary embodiments.
Figure 7:
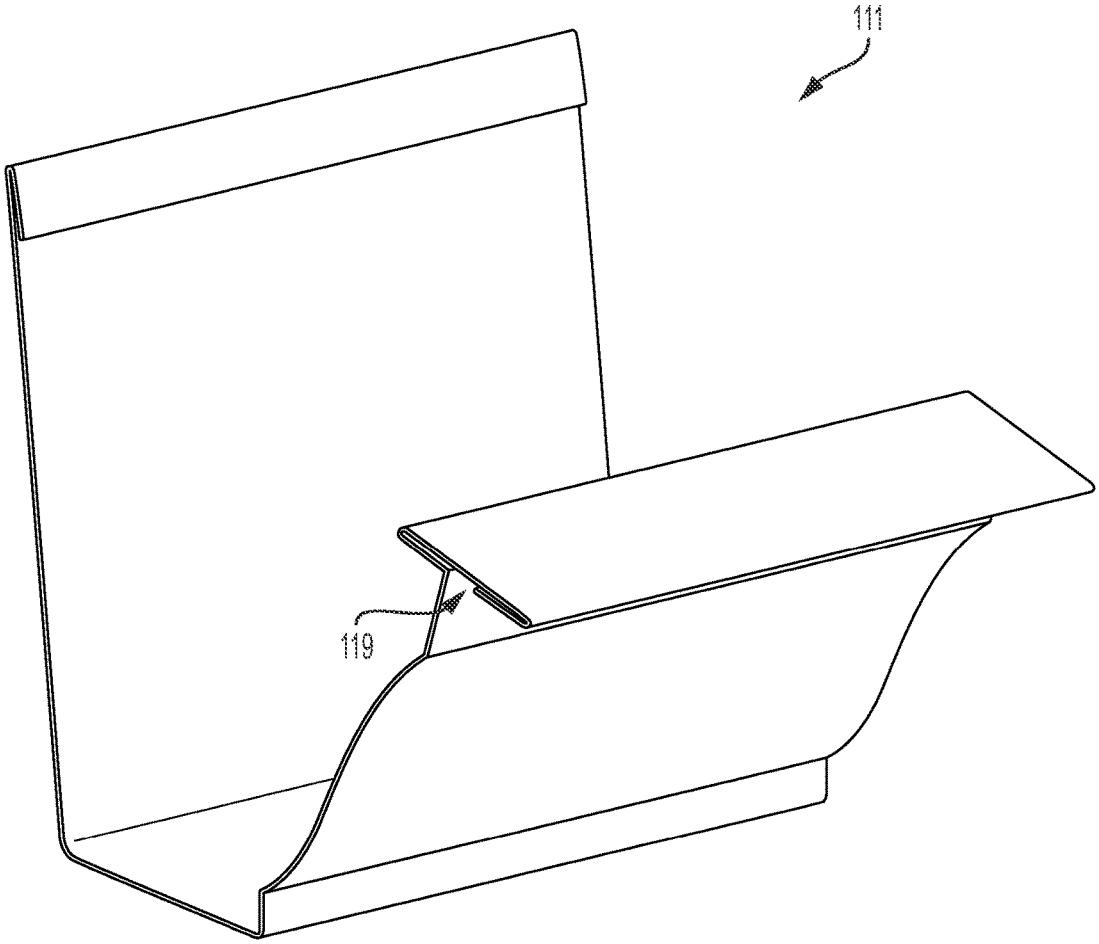

Gutter 111 has a continuous cross-sectional profile and includes spaced-apart front wall 112 and back wall 114 interconnected through bottom 116 and cooperatively defining water-collecting channel 119 therebetween. In embodiments, the back wall 114 is vertically higher than the back wall 114. Hangar lip 118 extends from front wall 112 in the direction generally toward the back wall 114 and functions to capture a forward flange of the hangers 131 beneath it. The hangar lip 118 is where the hangar hooks into the gutter extrusion (i.e., gutter, gutter profile). The drip edge 113 extends beyond the front wall 112 in the direction generally away from the back wall 114 and the structure to which the gutter 111 is attached, such that water running off of drip edge 113 is directed away from the front face of front wall 112, preventing "streaking" or "striping" commonly found in conventional gutter designs. Drip edge 113 preferably has a length corresponding to the length of gutter 111 to provide a continuous drip edge along the entire length of gutter 111. In one example, drip edge 113 extends from about 0.5 to about 1 inch beyond front wall 112. As shown, drip edge 113 and a portion of lip 118 are coplanar, and lip 118 further terminates in a bend 117 downward in the direction toward bottom 116. Thus, lip 118 is non-linear and may include approximately a 90-degree bend for capturing the forward flanges of hangers 131 to resist downward and rotational pulling forces on front wall 112. In embodiments, as depicted in FIG. 4, the gutter system 100 may include an inner miter 103, which is configured to handle high volumes of water, with an increased area where two gutter extrusions 111 meet at a corner. The inside miter includes an inner gusset 151, also shown in FIG. 10, and is configured to have a larger area to handle water runoff, as opposed to two gutters 111 would normally provide. In embodiments, the inside miter 103 includes a seamless configuration, which is customizable to the specific application for the structure. The inner gusset 151 permits the two gutter extrusions 111 to be joined. In further embodiments, as depicted in FIG. 5, the gutter system 100 may include an outer miter, which may include one or more corner caps 161. The corner cap 161 includes one or more flanges, not shown, which lock to lips of the gutter extrusions. In yet further embodiments, as depicted in FIGS. 4, 5, 9 and 10, the gutter system 100 may be fitted with one or more of tracking channels 141, inner corner gussets 151, corner caps 161, or a combination thereof. In yet further embodiments, the tracking channel 141 may be configured for use with the gutter system 100 or for use with a conventional systems (e.g., as a retrofit) for receiving the debris cover 101. In various embodiments, the tracking channel 141 could be screwed into a fascia of the structure and may include a hem that extends upward for securing behind a drip edge fascia 123, in which the hem may be a ¾ inch hem. In embodiments, the tracking channel 141 includes a reverse S curve for receiving and securing the debris cover 101. In embodiments, and as depicted in for example, FIG. 6, the drip edge 113 of an exemplary gutter extrusion has two ply thick portion of the gutter, providing extra strength and rigidity, and the bend of the drip edge is configured such that the exterior of the gutter is facing out. Thus, the color of the gutter can be seen on the outer face of the gutter, which is beneath the drip edge 113. In embodiments, the lip 118, as depicted in FIG. 6, can be configured to secure the debris cover 101 into a locking position, along with the hem 115 which can be secured under the fascia drip edge 123. In another embodiment, as depicted in FIG. 7, an exemplary gutter extrusion, includes a different bend, while permitting the lip of the extrusion, not show, to be similarly configured as that shown in FIG. 6, for securing the debris cover 101.

Figure 11:
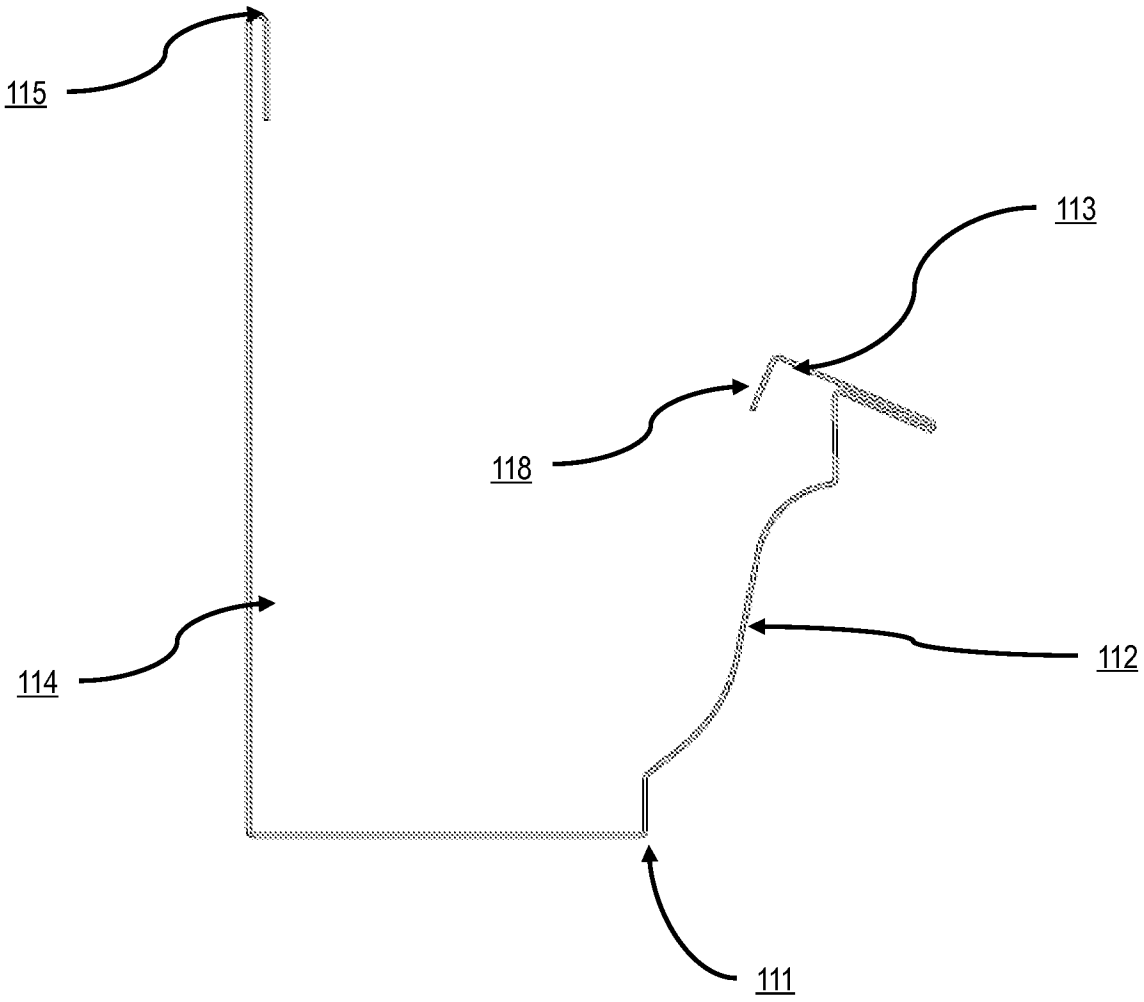
FIG. 11 is an illustration of a cross-sectional view of a gutter, according to exemplary embodiments.
Figure 12:
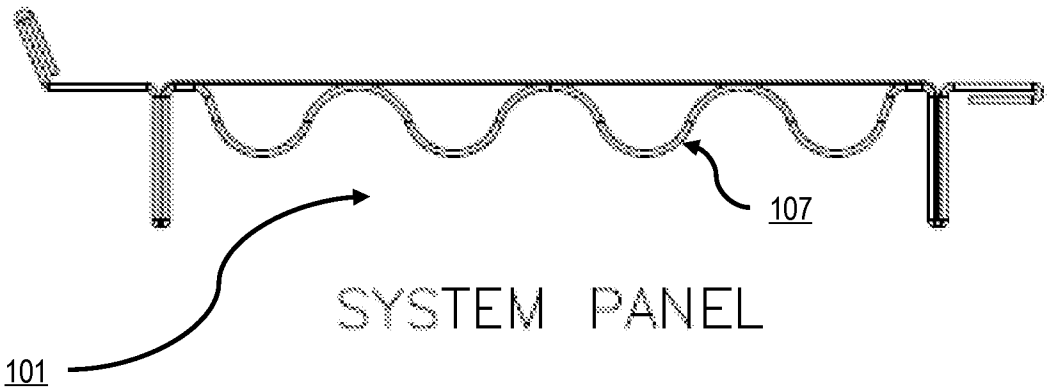
FIG. 12 is an illustration of a cross-sectional view of a debris cover, according to exemplary embodiments.
Figure 13:
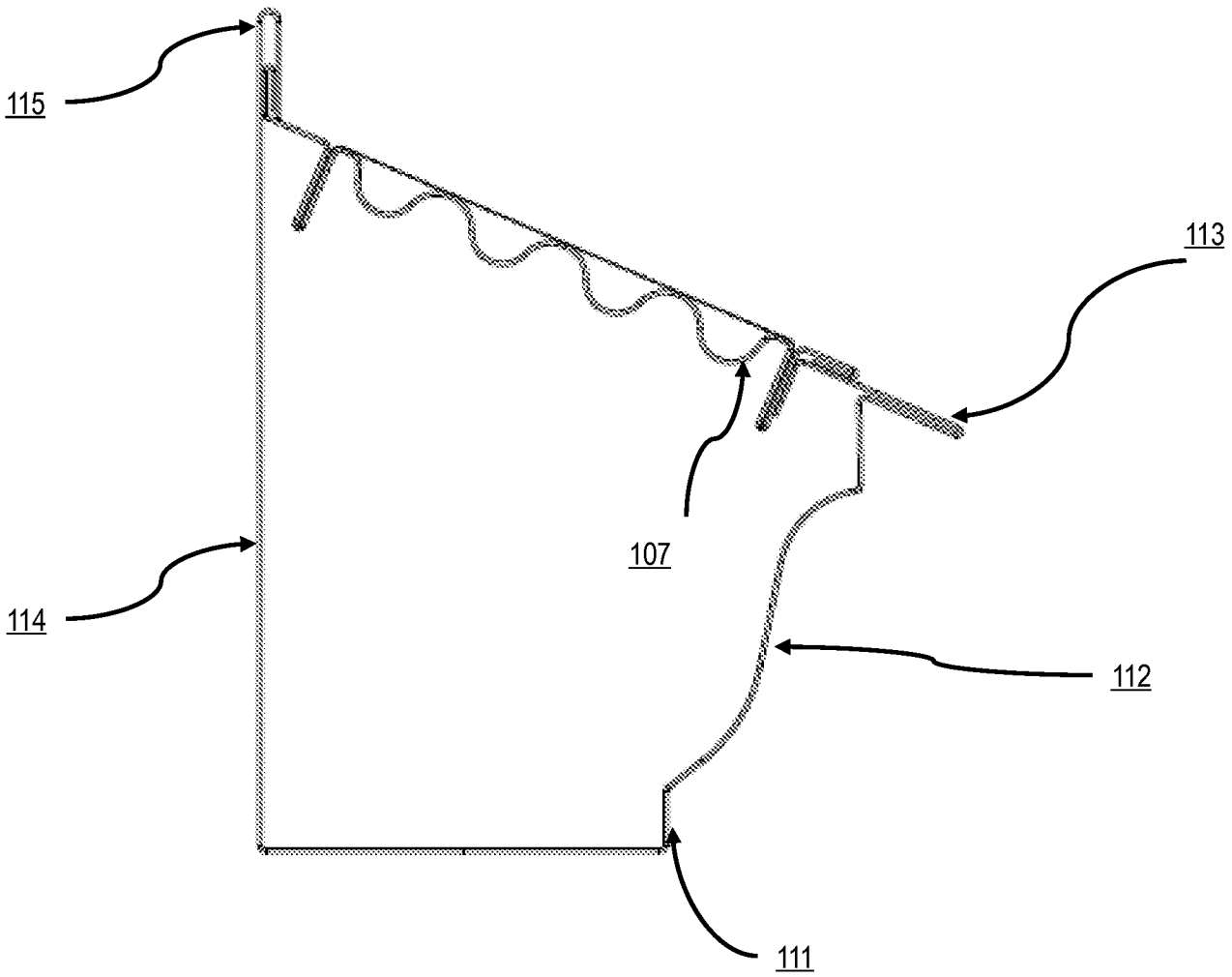
FIG. 13 is an illustration of a cross-sectional view of a gutter and debris cover, according to exemplary embodiments.

Gutter 111 further defines a "high-back" provided by back wall 114 extending upward vertically beyond (i.e. "above") the height of front wall 112. The height of back wall 114 functions to protect underlying the fascia of the structure from "backflow," i.e. water flowing against the direction of gravity over the top of back wall 114 and across the fascia of the structure. Thus, if the gutter overflows with an extremely high volume of water, the high back wall 114 being higher than the front wall 112, the overflow of water would flow over the front wall 112, thus preventing backflow into the structure. Back wall 114 further terminates in a fold with a free edge 110. In embodiments, and as depicted in for example, FIGS. 11-13, the lip in the direction generally toward front wall 112 and bottom 116, as depicted in FIG. 5. Referring specifically to FIGS. 1-3, free edge 110 of hem 115 is spaced apart from the rear flanges of hangers 131 such that the rear edge of a debris cover 101 can be received and maintained in the provided space. The high back wall gutter profile further allows the receipt of hangers 131 sloped in the direction of drip edge 113. As shown in FIGS. 1-3, the back wall 114 is generally linear and perpendicular to bottom 116, and front wall 112 is non-linear and has a profile that may vary. In embodiments, the back wall 114 covers the fascia of the structure with a metal surface, thereby protecting it from water damage. In addition, the back wall 114 is higher than conventional walls of conventional systems, and in embodiments, the back wall 114 may be 6¾ inches in height. As depicted in FIGS. 11-13, in further embodiments, the gutter 111 can include a high back wall 114 that has a hem 115 configured to receive and secure the debris cover 101. The debris cover 101 is configured to be locked behind the hem 115 of the gutter 111. This configuration is allows the secure positioning of the debris cover 101 at a predetermined pitch, defined by pitch in the range of 23 to 27 degrees, and in further embodiments, at a pitch defined by and angle of 25 degrees. In further embodiments, the debris cover 111 can be secured in place by press-fit, snap fit, etc.

In embodiments, the rain gutter system 100 further includes at least one hangar hanger 131, and preferably a plurality of hangers, spaced-apart and secured within gutter 111. Hangers 131 substantially span the distance between front wall 112 and back wall 114 and prevent their movement, caused by the flow of the water that hits the overlying debris cover, avoiding degradation of the fascia of the structure. Thus, the necessity for maintenance of the gutter system is also reduced. Hangers 131 may be installed spaced-apart from bottom 116 to avoid obstructing the flow of water longitudinally along the channel 119 of the gutter 111.

Figure 8:
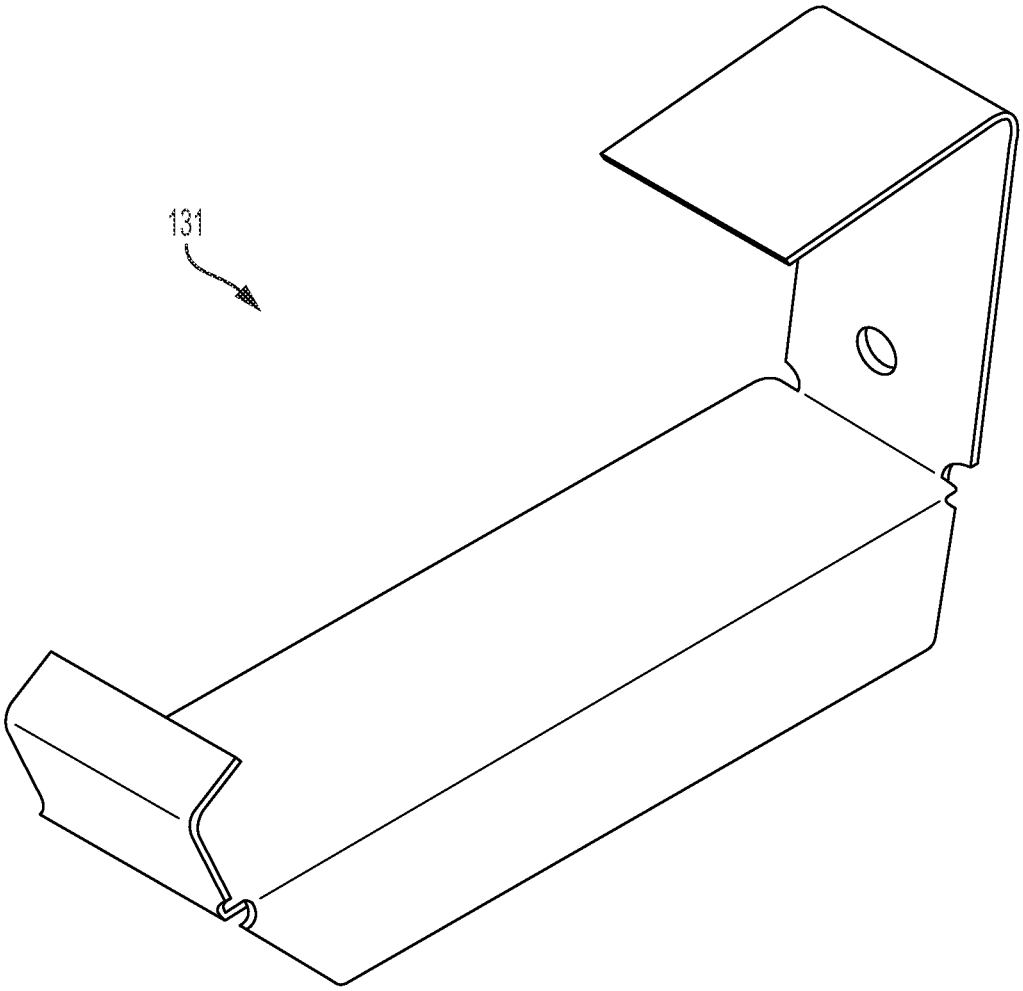
FIG. 8 is an illustration of an internal hangers, according to exemplary embodiments.
Figure 9:
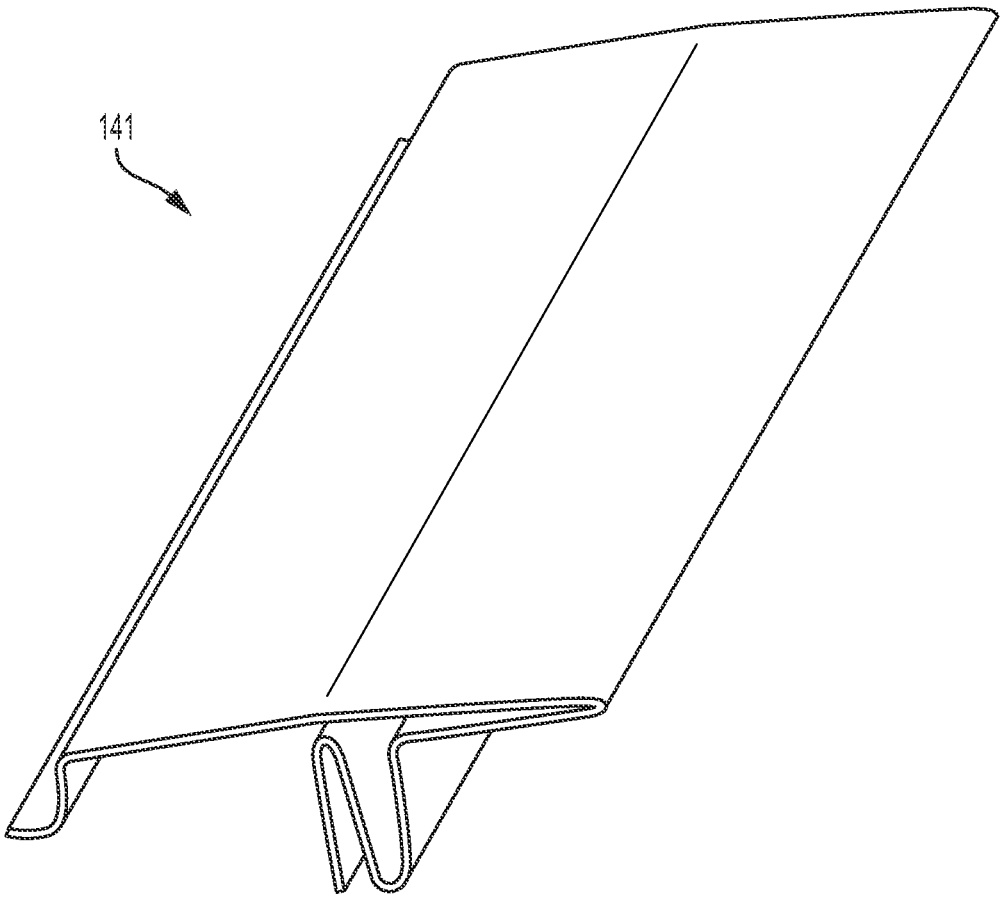
FIG. 9 is an illustration of a tracking channel, according to exemplary embodiments.
Figure 10:
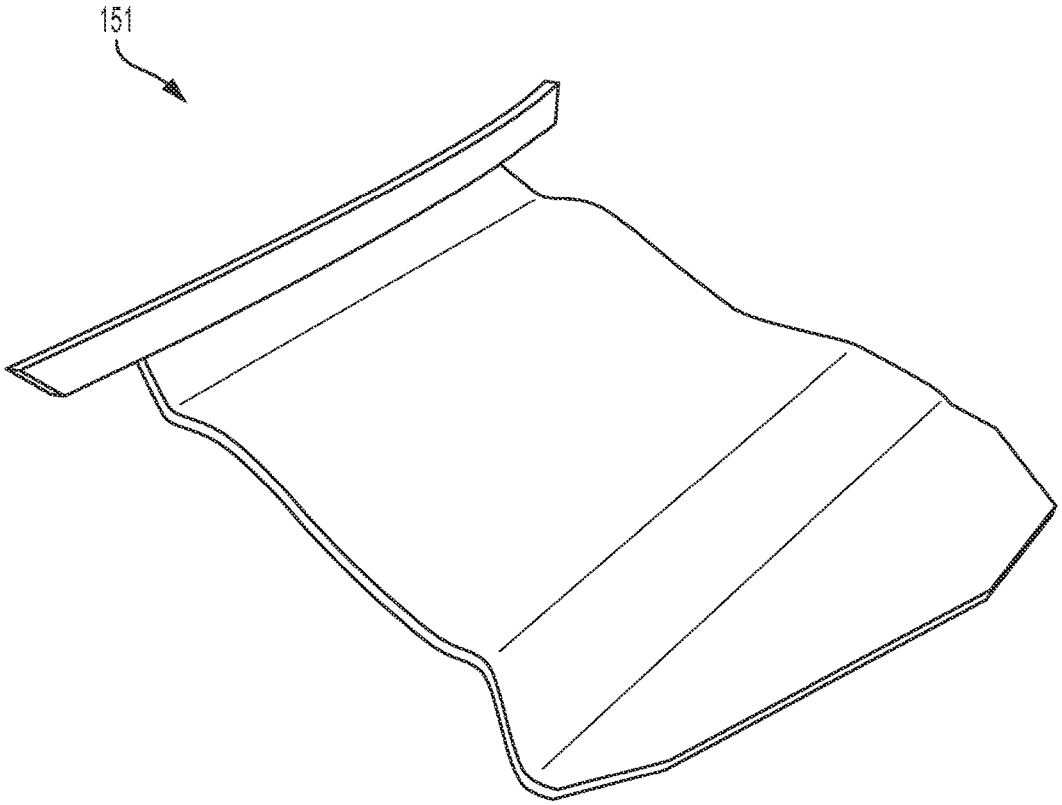
FIG. 10 is an illustration of an inside corner gusset, according to exemplary embodiments.

As shown in FIG. 8, hangers 131 are formed from a single piece of material bent to form a complex shape generally including a base, forward flange and rear flange. Forward flange and rear flange are generally L-shaped and include vertical portions extending generally perpendicularly from base and supporting portions oriented substantially perpendicular or at an angle to vertical portions in the direction facing one another. Supporting portion, also referred to as "support surface, supports an overlying debris cover 101 and is sloped in the direction toward drip edge. Rear flange extends vertically beyond forward flange to provide a sloped profile in the direction of forward flange. The vertical portions of the rear flanges may define openings therethrough for receiving conventional fasteners for attaching gutter 111 to the structure. Base includes downward flanges to provide rigidity to hangers 131, thus resisting twisting and bending forces.

Although not shown, in embodiments, each of the openings, may also be aligned horizontally or vertically on the vertical portion of the rear flange. In yet further embodiments, the opening may be aligned underneath the support surface to avoid natural elements (e.g., rain).

As depicted, in some embodiments, the hangers 131 are installed in gutter 111 such that drip edge 113 and support surfaces of the rear flanges are coplanar and sloped in the direction toward drip edge 113. In embodiments, debris cover 101 is cooperatively supported by support surface of rear flange and drip edge 113 in a sloped orientation in the direction of drip edge 113 such that water run-off from roof 121 is directed toward channels 105 defined by debris cover 52. As shown in FIGS. 12 and 13, the channels 105, in embodiments, maybe curved in shape, thereby providing increased strength as opposed to a straight channel. In yet further embodiments, the channels have a depth in the range if ⅜-¾ inches, which provides efficient wicking of water. Conventional debris panels are shallower in depth, thereby water has more water tension in such systems and often flows back out of such panels such that the water bubbles on the top surface of the panel. The deeper designs depicted in FIGS. 12 and 13 allow less water tension and increased water harvesting in the debris cover, and ultimately, allowing the gutter 111 to collect and remove more water. In embodiments, debris cover 101 includes openings 107 along the channels 105. The openings 107 within the channels 105 permit water to leave the channels 105, and thereby leave the debris cover 101 and fall into the gutter 111. In an exemplary embodiment, debris cover 101 is positioned to have a pitch defined by an angle in the range of 23-27 degrees with respect to horizontal. In further the debris cover is positioned to have a pitch defined by an angle of 25-degrees with respect to horizontal. In other embodiments, the pitch is 25 degrees. As shown in FIGS. 12 and 13, the openings 107 are positioned in a forward arrangement along the channels 105 such that when the debris cover 101 is pitched, the openings 107 follow that pitch and provide efficient removal of water from the debris cover 101, and thus reducing the chance of water backing up in the debris cover 101. In embodiments, the openings 107 are formed as slots along the channel 105, and are arranged in a slot forward design that follows the pitch of the debris cover. In further embodiments Alternative angles are envisioned so long as they are adequate for allowing time to collect water in the gutter system, while allowing debris to wash over and blow of the gutter system 100. Predetermined slopes, such as "4 in 12" or "5 in 12" slopes known to those skilled in the art are also envisioned, or at an incline corresponding to about the incline of overlying roof 121. The described degrees of pitch and placement of the openings 107 in a slot forward design provide optimal performance for the gutter system.

Rain gutter system 100 is configured for use with a variety of conventional debris cover designs, preferable designs generally including water-collecting channels covered with a fine mesh or "micromesh". As shown, elongated channels 105 of the debris cover 101 define openings 107 therethrough for passing water through to channel 119 of the gutter 111. The width of the mesh portion relative to the surface of debris cover 52 is dependent upon the amount of water desired to pass therethrough, and may be selected based on the distance required to be bridged from the fascia of the structure and/or the fascia drip edge 123 to the overlying edge of roof 121. Thus, the mesh portion may range from about one to a plurality of inches in length.

In embodiments, an end cap has a perimeter shaped to generally correspond to the shape defined by the collection of the profiles of front wall 112, bottom 116, back wall 114 and debris cover 101. The end cap sealingly engages gutter 111 and may be secured to gutter 111 by interference fit or using mechanical fasteners. End caps are provided in left- and right-handed versions to close off both ends of gutter 111. The end cap may be stamped or bent. The end cap may further function to maintain debris cover 111 in place, or alternatively, debris cover 111 may function to help to maintain the end cap in place, depending upon which overlaps.

In embodiments, the debris cover 111 includes a upper edge to the placed on the rear support surface, at least one opening 107, and a lower edge 73 to be place on the lip 118. The debris cover 101 may also include one or more elongated channel 105, a mesh 110, or a combination thereof. The upper edge and the lower edge may be a two layers edge formed by folding each tip of the edges on top of the each of the corresponding edge of the debris cover. Alternatively, the upper edge and the lower edge may be formed by folding each tip of the edges touching the low part of each of the corresponding edge of the debris cover. It is also envisioned that only one of the edges, i.e. either the upper edge or the lower edge, is folded. Both the upper edge and the lower edge may also be formed with only one layer of material, therefore, not bent or folded.

In embodiments, the debris cover 101 may include several elongated channels 105. In further embodiment, the debris cover 101 includes four elongated channels 105, which may be spaced apart at predetermined distances. In embodiments, the elongated channels may be defined with predetermined widths. Additionally, the surface of the debris cover may be comprised one or more openings 107 which may be spaced apart of each other at predefined distances, and of various shapes and sizes, all of which may be predefined.

The mesh 102 may be secured on top of the surface, preferably a mesh 102. In embodiments, the mesh may be formed with five thousand openings per square inch, to allow the water to efficiently penetrate, while keeping the debris out of the gutter system. In embodiments, the number of openings may be less than five thousand or higher than five thousand.

While a gutter system has been described with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A gutter system comprising:

a gutter extrusion;

at least one gutter hangar configured to be positioned within the gutter extrusion; and a debris cover, the debris cover including a micromesh screen and one or more channels, and the debris cover is configured to be secured on the at least one gutter hangar at a predetermined forward pitch, and wherein the debris cover is pitched on the gutter extrusion at an angle in the range of 23-27 degrees with respect to horizontal, each of the one or more channels of the debris cover has a consistent depth from a front edge of each channel to a rear edge of each channel in the range of ⅜ inches to ¾ inches and include openings defined therein, and the openings are aligned in a staggered configuration and follow the forward pitch of the debris cover and are pitched forward at the angle in the range of 23-27 degrees with respect to horizontal.

2. The gutter system of claim 1, wherein the one or more channels include at least one elongated channel and the openings are shaped as slots and are configured to allow liquids to flow out of the at least one elongated channel and into a channel of the gutter extrusion.

3. The gutter system of claim 1, wherein the gutter extrusion includes a channel, an integrated drip edge configured to direct liquids away from a front wall of the gutter, and a raised back wall of the gutter configured to protect an underlying fascia of a structure to which the gutter extrusion can be attached from liquid backflow.

4. The gutter system of claim 3, wherein the back wall extends vertically beyond the height of the front wall and terminates in a fold that extends in the direction of a channel of the gutter extrusion.

5. The gutter system of claim 3, wherein the at least one gutter hangar is configured to secure the gutter extrusion to the underlying fascia or rafter tails of the structure, wherein a flange of the back wall and a supporting surface of the at least one internal hangar define a space there between for receiving and maintaining an upper edge of the debris cover.

6. The gutter system of claim 1, wherein the at least one gutter hangar is configured to secure the gutter extrusion to the underlying fascia or rafter tails of a structure to which the gutter extrusion can be attached, wherein the at least one internal hangar supports the debris cover at the predetermined forward pitch.

7. The gutter system of claim 6, wherein the debris cover is directly attached to the gutter extrusion and to the at least one internal hangar, and is indirectly attached to the structure.

8. The gutter system of claim 1, further comprising a drip edge formed by an edge of the gutter extrusion and an edge of the debris cover.

9. The gutter system of claim 1, wherein the one or more channels include at least one elongated channel, the openings are shaped as slots.

10. The gutter system of claim 9, wherein the micromesh screen is formed having five thousand openings per square inch.

11. The gutter system of claim 9, wherein the openings are positioned at the bottom of the at least one elongated channel.

12. The gutter system of claim 1, wherein the micromesh screen is a micromesh panel created by a roll forming process.

13. The gutter system of claim 1, wherein the gutter extrusion includes a raised back wall with a hem that is configured to prevent liquid from traveling upward or horizontally toward a structure to which the gutter extrusion can be attached.

14. The gutter system of claim 13, wherein the hem of the raised back wall is configured to be positioned behind a fascia drip edge of a structure to which the gutter extrusion can be attached.

15. The gutter system of claim 13, wherein the hem of the raised back wall includes a free end, and the debris cover is configured to be secured under the free end of the hem at the predetermined forward pitch.

16. The gutter system of claim 1, further comprising one or more of tracking channels, inner corner gussets, and corner caps.

* * * * *